US005651204A

United States Patent [19]

Hulsey et al.

[11] Patent Number: 5,651,204

[45] Date of Patent: Jul. 29, 1997

[54] ORNAMENTAL MAGAZINE BASE

[76] Inventors: David A. Hulsey, 2710 Duane Dr., Meridian, Id. 83642; Don B. Lopez, 6466 W. Autumnwood, Boise, Id. 83703

[21] Appl. No.: 510,913

[22] Filed: Aug. 3, 1995

[51] Int. Cl.[6] ..... F41A 9/61

[52] U.S. Cl. ..... 42/50; 42/6; 42/49.01; 42/60; 42/7; 42/49.02

[58] Field of Search ..... 42/50, 6, 49.01, 42/60, 7, 49.02; 124/40

[56] References Cited

U.S. PATENT DOCUMENTS

| | | | |
|---|---|---|---|
| 3,143,819 | 8/1964 | Stevens, Jr. | 42/50 |
| 4,276,709 | 7/1981 | Bross | 42/71 |
| 4,495,720 | 1/1985 | Bross | 42/7 |
| 4,592,160 | 6/1986 | Bross | 42/7 |
| 4,862,619 | 9/1989 | Baldus et al. | 42/7 |
| 5,461,811 | 10/1995 | Ciener | 42/50 |
| 5,526,600 | 6/1996 | Chesnut et al. | 42/50 |

OTHER PUBLICATIONS

Edited by Jack Lewis, Handguns '92, Fourth Edition, Chapter 18 "For the Well Dressed Revolver", pp. 208–211.

*Primary Examiner*—Charles T. Jordan
*Assistant Examiner*—Meena Chelliah
*Attorney, Agent, or Firm*—Ken J. Pedersen; Barbara S. Pedersen

[57] ABSTRACT

The present invention relates to an ornamental base attached to an ammunition magazine for magazine fed weapons, particularly handguns. The ornamental base is attached to a conventional magazine. A locking means comprising a hook shaped tab and aperture is used to keep the ornamental base securely attached to the magazine. The locking means is accessible through an elongated channel extending from the back edge of the base plate to the aperture. This type of locking means allows the entire outside surface of the base plate to be utilized for decoration as desired.

4 Claims, 3 Drawing Sheets

ORNAMENTAL MAGAZINE BASE

BACKGROUND OF THE INVENTION

1. Field of Invention

This invention relates to an ornamental base for an ammunition magazine used in magazine fed firearms, particularly handguns.

2. Description of Prior Art

U.S. Pat. No. 4,276,709 (Bross '709) discloses a decorative pommel mounted to the stock of a handgun. The pommel has a mounting boss extending transversely from the pommel. The mounting boss is disposed between the handle's stocks. The pommel also has a pommel plate on its bottom surface which may be shaped to conform with the stocks.

U.S. Pat. No. 4,495,720 (Bross '720) discloses a decorative pommel and means for mounting it to a magazine which is releasably contained within the grip of the handgun. The interior recess of the pommel is slidably attached to the magazine and uses a releasable detent tab to keep the pommel on the magazine. The pommel is generally oval and conforms to the shape of the gun's grip.

U.S. Pat. No. 4,592,160 (Bross '160) discloses a means for attaching a decorative pommel to a cartridge magazine and is generally oval and conforms to the shape of the grip. The pommel has an elevated plateau having a detent receiving opening for securing the pommel to the magazine.

U.S. Pat. No. 4,862,619 (Baldus et al. ) discloses a magazine adaptor for use with extended firearm magazines. The adaptor is contoured to the butt of the pistol or firearm. Baldus et al. also discloses a locking means for securing the adaptor to the magazine using a detent tab and an aperture in the adaptor.

SUMMARY OF THE INVENTION

The present invention relates to an ornamental base slideably attached to an ammunition magazine for magazine fed weapons, particularly handguns. The ornamental base is slideably attached to a conventional magazine comprising a tubular case, a compression spring, a follower, and an end plate. A locking means comprising a hook shaped tab and aperture is used to keep the ornamental base securely attached to the magazine. The locking means is accessible through an elongated channel extending from the back edge of the base plate to the aperture. This type of locking means allows the entire outside surface of the base plate to be uninterrupted by any aperture for releasing the base and utilized for decoration as desired.

DESCRIPTION OF THE PREFERRED EMBODIMENT

Figure 1:
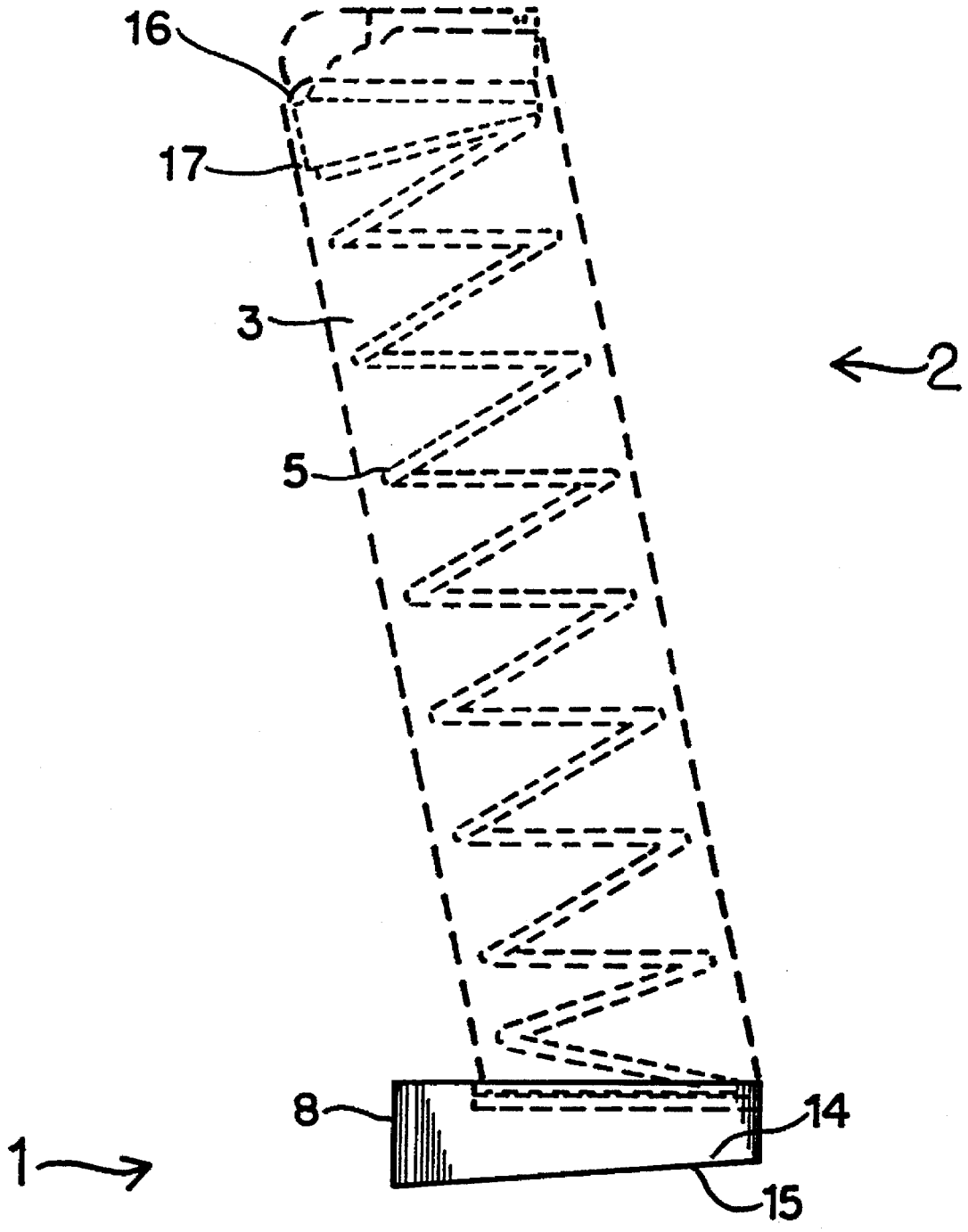
FIG. 1 is a side view of the ornamental base plate attached to a magazine.

This invention relates to an ornamental base for an ammunition magazine for magazine fed weapons, particularly handguns. Referring to the Figures, the ornamental base 1 slideably attaches to a conventional ammunition magazine 2 as shown generally in FIG. 2. A typical magazine 2 comprises a metal, tubular case 3 that is generally rectangular and has two open ends. (See FIGS. 1 & 2) The tubular case 3 has a front and back end. The bottom end of the tubular case 3 has a horizontal flange 4 extending outwardly from each longitudinal sidewall. Alternatively, the bottom end of the tubular case 3 has a horizontal flange 4 extending inwardly from each longitudinal sidewall.

An elongated compression spring 5 is disposed within the tubular case 3. The compression spring 5 has a first and a second end and a plurality of coils. The first end of the spring 5 movably engages a conventional follower. The follower has an upper and a lower portion. The lower portion of the follower is a tang 17 and is disposed within the coils near the first end of the spring. The upper portion of the follower is contoured for engaging the ammunition.

Figure 2:
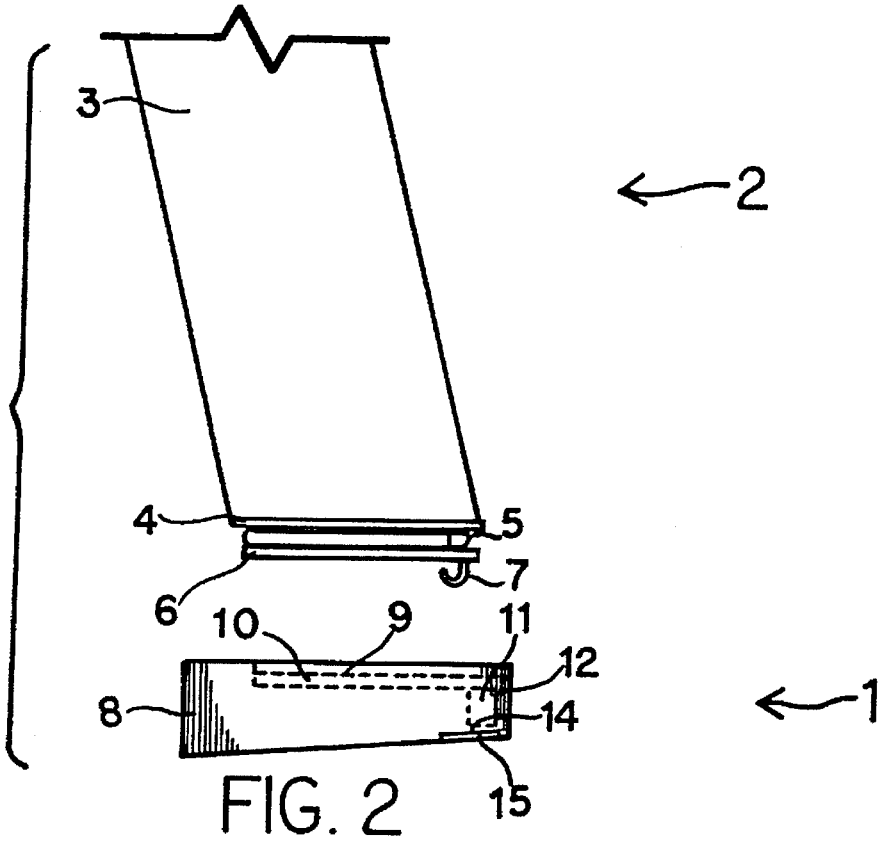
FIG. 2 is an exploded side view showing the base plate and magazine.

A thin end plate 6 having a generally rectangular shape is disposed within the bottom end of the tubular case 3 (See FIG. 2). The end plate 6 has a front and a back end. The end plate 6 forcibly engages the second end of the compression spring 5. The outside surface of the end plate 6 has a hook shaped tab 7 extending downwardly, perpendicular to the end plate's 6 outside surface.

Figure 3:
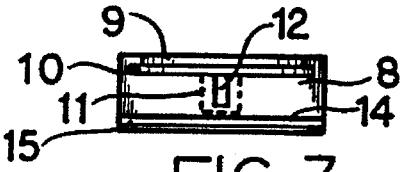
FIG. 3 is an end view of the base plate.
Figure 4:
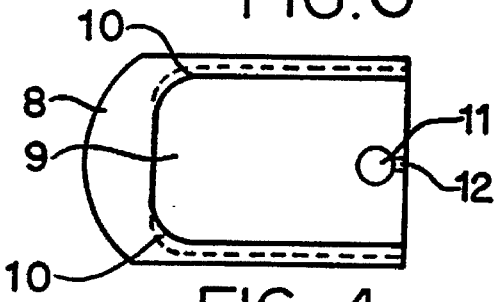
FIG. 4 is a top view of the base plate.

A base plate 8, preferably generally rectangular in shape, is slideably attached to the horizontal flanges 4 at the bottom end of the tubular case 3. The base plate 8 has an inside and outside surface. The inside surface of the base plate 8 has a recessed area 9 for receiving the bottom end of the magazine 1. (See FIGS. 2–4) The longitudinal sides of the recess 9 have grooves 10 adapted to receive the tubular case's horizontal flanges 18.

The base plate 8 also has a front and back edge. The recess 9 on the inside surface of the base plate 8 also has an aperture 11 for receiving the hook shaped tab 7. The hook shaped tab 7 and the aperture 11 are aligned. A thin channel 12 extends from the rear edge of the base plate 8 to the aperture 11. (See FIGS. 3 & 4) Preferably, channel 12 is narrower than the hook shaped tab 7.

An alternative embodiment of a base plate 8 made to cooperate with a tubular case 3 having inwardly extending horizontal flanges 18 comprises a generally flat inside surface. The longitudinal side walls of the base plate 8 have horizontal grooves 19 adapted to engage the inwardly extending horizontal flanges 18. This embodiment also comprises the aperture 11, hook shaped tab 7, and channel 12 as in the preferred embodiment. The different embodiment of the grooves 19 does not affect the use of the base plate 8.

The base plate 8 is slideably attached to the tubular case 3 by engaging the groves 10 at the rear edge of the base plate 8 with the forward end of the tubular case's horizontal flanges 4 and sliding the base plate 8 rearward. After sliding the base plate 8 into place, the force of the compression spring 5 exerted against the end plate 6 causes the hook shaped tab 7 to seat in the base plate's aperture 11. Once the hook shaped tab 7 is seated, the ornamental base 1 is locked onto the magazine 2.

The ornamental base 1 may be removed only by forcing the bottom end of the hook shaped tab 7 upward and out of the aperture 11 using an instrument inserted through the channel 12 at the back edge of the base plate 8. Simultaneous with pushing the hook shaped tab 7 upward, the base plate 8 is slid forward.

Figure 5:
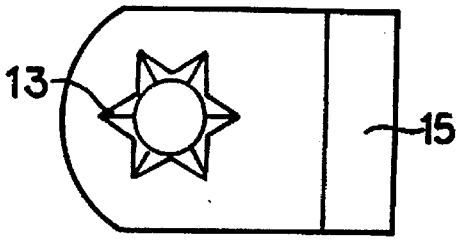
FIG. 5 is a bottom view of the base plate.
Figure 6:
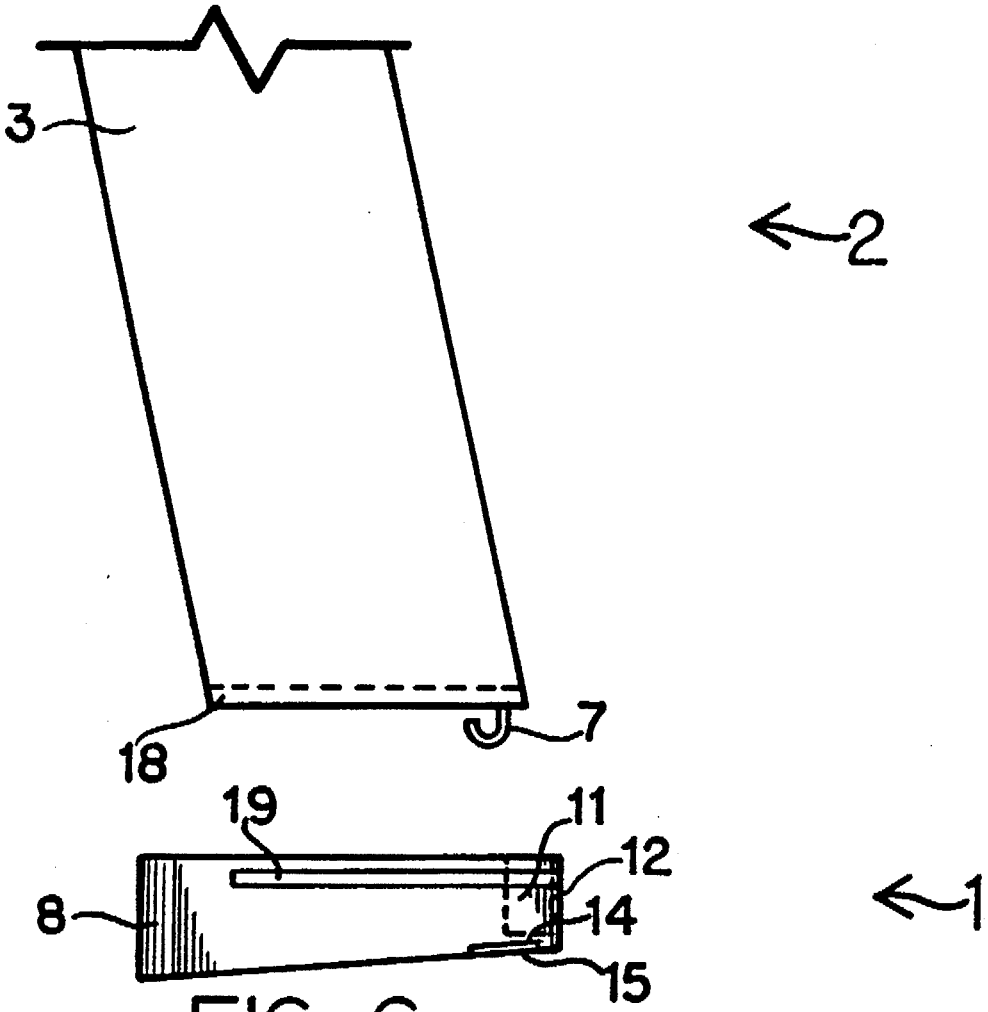
"FIG. 6 is an exploded side view of an alternative embodiment, showing the base plate and magazine."
Figure 7:
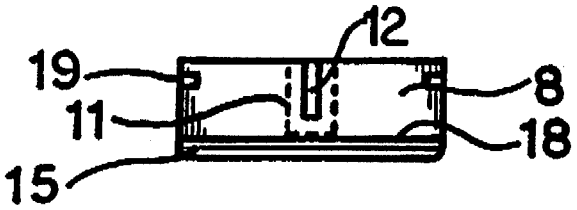
"FIG. 7 is an end view of the base plate of FIG. 6."

The outside surface of the base plate 8 has a recess (not shown) for receiving an ornamental piece 13. (See FIG. 5)

The ornamental piece 13 and recess may be positioned as desired. The ornamental piece 13 may be attached by conventional means including an adhesive material. A recessed area 14 for an engraved plate 15 is along the back edge of the base plate's 8 outside surface. When the engraved plate 15 is attached to the base plate 8, the outside surface is smooth. The engraved plate 15 is not an essential item. If the engraved plate 15 is not used the outside surface of the base plate 8 is flat . The engraved plate 15 can be attached to the base plate 8 by conventional means such as an adhesive material or even small screws.

Bross '160 and Bross '720 disclose a pommel utilizing a small detent tab and an aperture centered in the base. Releasing the detent in both Bross '160 and Bross '720 requires inserting a tool into a special opening in the magazine case. Having the aperture in the magazine case requires using a special magazine or modifying a conventional magazine.

One way to use the present invention is to hold a conventional magazine in one hand with the bottom end of the magazine facing up. The thin end plate 6 is pushed downward to engage the compression spring 5 and dispose the thin end plate 6 within the tubular case 3 of the magazine. In this position, the hook shaped tab 7 is facing upward as it extend outwardly from the thin end plate 6. The back edge of the base plate 8 is positioned near the front end of the magazine 2 in preparation of engaging the horizontal flanges 4 at the bottom end of the tubular case 3. The inside surface of the base plate 8 that is preferably recessed and has grooves 10 adapted to receive the horizontal flanges 4 is facing the thin end plate 6.

The base plate 8 is slid backwards onto the magazine 2 until the hook shaped tab 7 is disposed in the aperture 11 on the inside surface of the base plate 8. The base is now locked onto the bottom of the tubular case 3. The compression spring 5 continues to exert force on to the thin end plate 6 which in turn causes the hook shaped tab 7 to stay within the aperture 11. The magazine can be used in a fire arm without concern that the base plate 8 will accidentally be dislodged.

Removing the base plate 8 from the magazine 2 requires inserting a tool in the narrow channel 12 on the rear edge of the base plate 8. This is a key difference from the prior art because by having the access through the base plate 8, a conventional magazine 2 can be used with this ornamental base 1. In the prior art, special magazine cases with access for releasing the locking means had to be used, or at least modifications had to be made to the magazine so that it could be released.

To release the base plate the tool is pushed against the hook shaped tab 7 to exert force against the compression spring 5. With the outside surface of the ornamental base 1 facing up, the hook shaped tab 7 is pushed downward. At the same time the base plate 8 is slid towards the front end of the tubular case 3. Once the hook shaped tab 7 is removed from the aperture 11, the base plate 8 can be completely removed by sliding the base plate 8 forward towards the front end of the tubular case 2 and disengaging the horizontal flanges 6 on the bottom end of the tubular case 2 from the corresponding grooves 10 in the base plate 8.

The current invention differs from both Bross '720 and Bross 160 by having a positive locking system accessible from the back edge of the base that prevents accidental removal of the ornamental base. A hook shaped tab is disposed in an aperture on the inside surface of the base plate as a means for locking the base onto the magazine. The aperture for receiving the hook shaped tab and the tab are aligned and are located near the back edge of the base plate and end plate, respectively.

A narrow channel extends from the back edge of the base plate to the aperture. The ornamental base can be removed only by inserting a thin, elongated object into the channel and pushing upward against the hook shaped tab disposed in the aperture while simultaneously sliding the base plate forward. This locking system allows the ornamental base to be removed using an aperture assessable from the back edge of the base plate.

The prior art uses a hook shaped tab on the end plate facing upward and engaging the second end of the compression spring. However, in the current invention, the compression spring forcibly engages the end plate and the hook shaped tab extends downward to lock the ornamental base on to the magazine.

Although this invention has been described above with reference to particular means, materials and embodiments, it is to be understood that the invention is not limited to these disclosed particulars, but extends instead to all equivalents within the scope of the following claims.

What is claimed is:

1. An ornamental base for an ammunition magazine, comprising:

a. a conventional magazine further comprising:

i. a generally rectangular, tubular case having two ends, said tubular case being open at both ends, said tubular case having a top and bottom end, said tubular case having longitudinal sidewalls, and said tubular case having a flange extending horizontally outward from each longitudinal edge, ii. a compression spring having a first and second end, said spring having a plurality of coils, iii. a follower movably engaging said first end of said compression spring, said follower having an upper and lower portion, said upper portion being contoured to engage a cartridge, said lower portion being disposed in said coils of said first end of said compression spring, and iv. an end plate being a generally rectangular shape, said end plate frictionally engaging said second end of said spring, said end plate being disposed within said bottom end of said tubular case, said end plate having an inside and outside surface;

b. a base piece having an inside and outside surface, said base piece being slideably attached to the bottom end of said tubular case, said base piece having a recessed area on said outside surface, said base piece having a front and back edge, said base piece having a recess on said inside surface for receiving said tubular case, and said base piece further having grooves along each longitudinal edge of said recess on said inside surface, said grooves being aligned with said flange;

c. at least one ornamental piece disposed in said recesses on said outside surface of said base plate; and d. means, integral with said end plate, for locking said base piece to said magazine, said locking means comprising:

i. a hook shaped tab integral with said end plate, said tab extending outwardly from said outside surface of said bottom plate, ii. an aperture on said inside surface of said base piece for receiving said tab, said aperture being aligned with said tab, said aperture being near said back edge of said base piece, and iii. a narrow channel on said inside surface of said base piece, said channel being parallel to the longitudinal axis of said base piece, said channel beginning at said back edge of said base piece and being in communication with said aperture.

2. An ornamental base for an ammunition magazine as recited in claim 1, wherein said channel is narrower than said aperture.

3. An ornamental base for an ammunition magazine, comprising:

a. a conventional magazine further comprising:

i. a generally rectangular, tubular case having two ends, said tubular case being open at both ends, said tubular case having a top and bottom end, said tubular case having longitudinal sidewalls and having a flange extending horizontally inward from each longitudinal edge, ii. a compression spring having a first and second end, said spring having a plurality of coils, iii. a follower movably engaging said first end of said compression spring, said follower having an upper and lower portion, said upper portion being contoured to engage a cartridge, said lower portion being disposed in said coils of said first end of said compression spring, and iv. an end plate being a generally rectangular shape, said end plate frictionally engaging said second end of said spring, said end plate being disposed within said bottom end of said tubular case, said end plate having an inside and outside surface;

b. a base piece having an inside and outside surface, said base piece being slideably attached to the bottom end of said tubular case, said base piece having a recessed area on said outside surface, said base piece having a front and back edge and said base piece further having grooves along each longitudinal edge of said recess for receiving said flanges, said grooves being aligned with said flanges;

c. at least one ornamental piece disposed in said recesses on said outside surface of said base plate; and d. means, integral with said end plate, for locking said base piece to said magazine, said locking means comprising:

i. a hook-shaped tab integral with said end plate, said tab extending outwardly from said outside surface of said bottom plate, ii. an aperture on said inside surface of said base piece for receiving said tab, said aperture being aligned with said tab, said aperture being near said back edge of said base piece; and iii. a narrow channel on said inside surface of said base piece, said channel being parallel to the longitudinal axis of said base piece, said channel beginning at said back edge of said base piece and being in communication with said aperture.

4. An ornamental base for an ammunition magazine as recited in claim 3, wherein said channel is narrower than said aperture.

* * * * *